US006427432B1

(12) United States Patent
Pourtier

(10) Patent No.: US 6,427,432 B1
(45) Date of Patent: Aug. 6, 2002

(54) METHOD AND INSTALLATION OF CABLE MILL FOR PRODUCING A CABLE AT LEAST PARTIALLY UNTWISTED

(75) Inventor: Pascal Pourtier, Nogent sur Marne (FR)

(73) Assignee: Pourtier Pere & Fils-P.P.F., Chelles (FR)

( * ) Notice: Subject to any disclaimer, the term of this patent is extended or adjusted under 35 U.S.C. 154(b) by 0 days.

(21) Appl. No.: 09/623,909

(22) PCT Filed: Mar. 29, 2000

(86) PCT No.: PCT/FR00/00788

§ 371 (c)(1),
(2), (4) Date: Jan. 10, 2001

(87) PCT Pub. No.: WO00/67263

PCT Pub. Date: Nov. 9, 2000

(30) Foreign Application Priority Data

Apr. 29, 1999 (FR) ..... 99 05435

(51) Int. Cl.[7] ..... D07B 3/08

(52) U.S. Cl. ..... 57/58.49; 57/66

(58) Field of Search ..... 57/3, 6, 16, 58.49, 57/58.52, 58.54, 58.55, 58.63, 58.83, 59, 67, 127.5, 211, 237, 294, 66

(56) References Cited

U.S. PATENT DOCUMENTS

| | | | | |
|---|---|---|---|---|
| 2,921,429 A | | 1/1960 | Haugwitz | |
| 5,622,039 A | * | 4/1997 | Thompson | 57/3 |
| 6,209,299 B1 | * | 4/2001 | Landry et al. | 57/58.84 |

FOREIGN PATENT DOCUMENTS

| | | |
|---|---|---|
| DE | 1 800 014 | 5/1969 |

* cited by examiner

*Primary Examiner*—Danny Worrell
*Assistant Examiner*—Shaun R. Hurley
(74) *Attorney, Agent, or Firm*—Young & Thompson

(57) ABSTRACT

On a common production line, a twist-free assembly station, at which various wires are assembled without individually twisting is followed by a twisting station at which a cable formed by the wires is twisted at least once.

6 Claims, 1 Drawing Sheet

METHOD AND INSTALLATION OF CABLE MILL FOR PRODUCING A CABLE AT LEAST PARTIALLY UNTWISTED

BACKGROUND OF THE INVENTION

The present invention relates generally to cables made by twisting one or more wires to form a strand.

It relates more particularly to the situation in which the wires are insulated electrical conductors of an electrical cable, and even more particularly, although not necessarily exclusively, the situation in which only two wires are used and the cable constitutes what is usually referred to as a twisted pair.

It is known that the twist that is conjointly applied to two wires to assemble them into a strand normally also twists each of the two wires individually on itself.

It is also known that a pair of insulated conductive wires constitutes a capacitor whose impedance depends not only on the frequency of the electrical signals conveyed, and quickly becomes non-negligible when that frequency is relatively high, but also on the capacitance between the two wires.

Finally, that capacitance is known to itself depend on the nature and the thickness of the dielectric constituting the insulative sheath of the two wires.

Because of inevitable fabrication tolerances, this thickness is not strictly constant all around the wires.

There is also inevitably some eccentricity of the conductive core of the wires relative to their insulative sheath.

If the wires are assembled with concomitant twisting of each of them, as previously indicated, the wires are in contact with each other along a generatrix which remains the same throughout their length.

The effects of eccentricity of the conductive core relative to the insulative sheath are themselves operative uniformly throughout the length of the wires, and as a result of this there may be large differences in capacitance from one pair to another Consequently the impedance can vary widely from one pair to another at comparable frequencies, which in practice leads to rejection of any pair whose impedance is too high or too low.

It has therefore been proposed to assemble the wires without hem being individually twisted.

For example, in a first system already envisaged for this purpose each of the wires to be assembled is paid out from a double-twist twisting machine operating as a paying out device and the wires are assembled by a double-twist twisting machine operating in the conventional way.

This first system therefore requires three rotating members, namely tho three double-twist twisting machines employed.

Also, production rate, or productivity, expressed as a number of twists per unit time, is equal to twice the rotational speed of the system in this case.

In another system known in the art, each of the wires to be assembled is paid out from a single-twist twisting machine and, as before, the wires are assembled by a double-twist twisting machine.

However, and just as before, this requires three rotating members, namely the two single-twist twisting machines and the double-twist twisting machine, and the production rate of the system is limited to twice its rotational speed.

SUMMARY OF THE INVENTION

A general object of the present invention is a system enabling the production of cables of satisfactory quality, in particular with regard to a relatively consistent impedance from one cable to another, but which advantageously requires fewer rotary members than and has a higher productivity than prior art systems.

It is based on the known fact that to obtain a cable of sufficient quality it is in practice possible to tolerate partial twisting, or conversely, partial backtwisting, of the wires The backtwisting of the wires can be from 25% to 50%, for example, and is preferably from 30% to 40%.

It is also based on the fact that a twisting machine has already been proposed for making large-diameter cables (or, incidentally, high-performance pairs for long distances) and is usually referred to as a lyre type horizontal pairing machine, although the path of the wires is not necessarily horizontal. It is adapted to combine two wires into a cable without any individual twisting of the wires, the twisting machine in practice using, in addition to a first paying out spool, a lyre-type assembly device within which there is a second paying out spool.

To be more precise, the present invention consists firstly of a cable-making method for making an at least partly backtwisted cable using on a common production line a twist-free assembly station at which the various necessary wires are assembled without individually twisting them followed by a twisting station at which the cable as a whole formed by the wires is twisted at least once; it also consists of any cable-making installation using a method of the above kind.

For example, in the case of fabricating a single pair, the cable-making installation of the invention very simply uses a lyre-type horizontal pairing machine for the twist-free assembly station and a double-twist twisting machine for the twisting station.

Thus only two rotary members are used, namely the lyre-type horizontal pairing machine of the twist-free assembly station and the double-twist twisting machine of the twisting station If the two rotary members turn at the same speed, the production rate of the system is three times their rotational speed.

Conjointly, assembled without twist at the exit from the lyre-type horizontal pairing machine, the two wires are then subject to only partial twisting in the double-twist twisting machine downstream of the latter.

In other words, it is just as if, overall, they were subject to some degree of backtwisting.

In practice, this depends on the relative rotational speeds of the two rotary members employed.

The rate of backtwisting can advantageously and easily be varied from one production run to another, as required.

The system preferably includes between the twist-free assembly station and the twisting station a tension measuring device controlling a braking device controlling the first paying out spool and he tension in the cable at tho exit from the twist-free assembly station is preferably substantially equal to twice the tension of the wire at the exit from the second paying out spool.

Equal tension in the two wires guarantees the geometrical quality of the resulting cable and can advantageously be obtained relatively easily and economically without knowing the tension in the wire paid out from the first paying out spool and even though, in the case of a wire that has been routed over a rotary member, a direct knowledge of that tension would require the use otherwise more complex and costly means.

BRIEF DESCRIPTION OF THE DRAWINGS

The features and advantages of the invention will emerge from the following description, which is given by way of example and with reference to the accompanying diagrammatic drawings, in which.

DETAILED DESCRIPTION OF THE PREFERRED EMBODIMENTS

Figure 1:
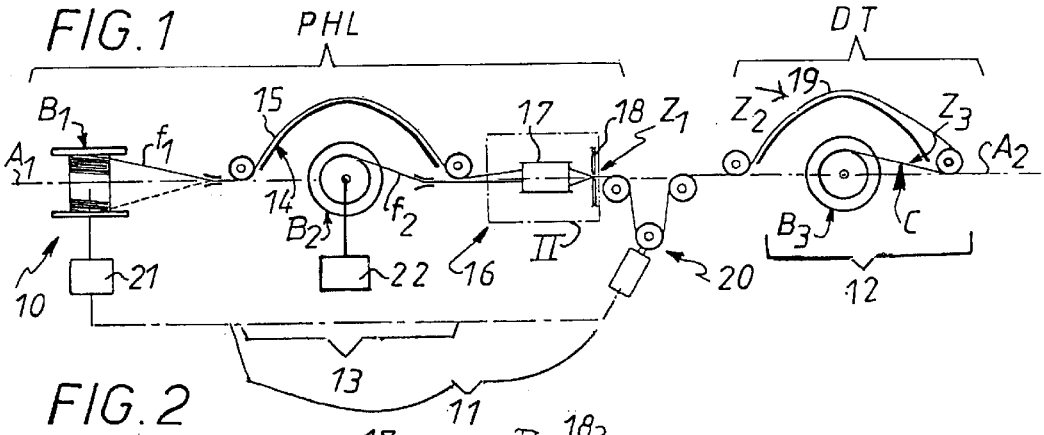
FIG. 1 shows a cable-making installation according to the invention.
Figure 2:
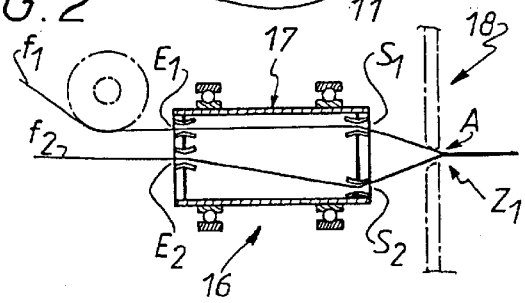
FIG. 2 shows the detail II from FIG. 1 to a larger scale.
Figure 3:
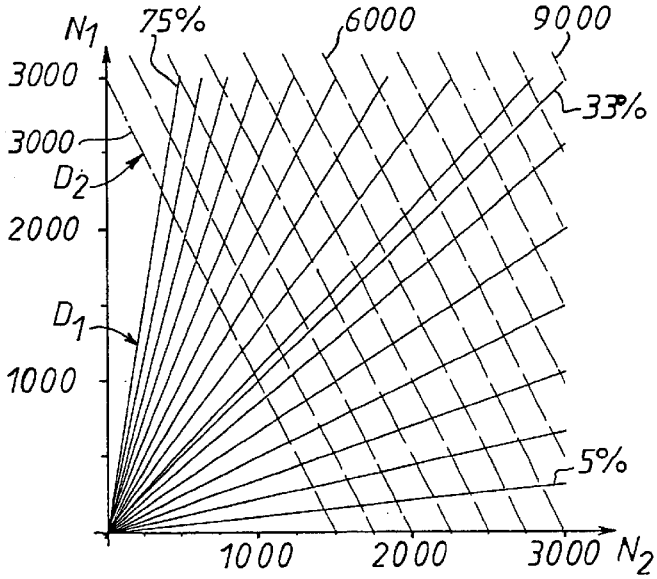
FIG. 3 is a set of curves corresponding to the operation of the cable-making installation.

FIGS. 1 to 3 show, by way of example, the application of the invention to the simple situation of assembling together two wires f1, f2, the resulting cable c being a single twisted pair.

According to the invention, the cable-making installation 10 employed for this purpose includes, in series, on a common production line, firstly, a twist-free assembly station 11 adapted to combine the two wires f1, f2, without individual twisting, followed by a twisting station 12 adapted to apply at least one twist to the resulting assembly.

In the embodiment shown, the twist-free assembly station 11 includes at least one bay 13 in addition to a first paying out spool B1 from which the wire f1 is paid out. In practice the bay 13 is formed by an assembly device 14 within which there is a second paying out spool B2 from which the wire f2 is paid out.

As this example concerns the fabrication of a single pair, there is only one bay 13.

As shown diagrammatically in FIG. 1, for example, the assembly device 14 of the bay 13 is a lyre-type assembly device.

It includes a lyre 15 along which the wire f1 is fed. These arrangements are well known in the art and are not described in detail here.

The twist-free assembly station 11 has an assembly system 16 at its exit.

As shown more completely in FIG. 2, for example, the assembly system 16 includes a drum 17 which has an axial entry E2 for the wire f2, at least one peripheral entry E1 for the wire f1 and exclusively peripheral outlets S1, S2, etc. distributed around a common circumference, in the manner of a laying plate. It also includes a die 18 downstream of the drum 17 and common to the set of wires f1, f2, etc.

Since there are only two wires f1, f2 in this instance, the drum 17 has only one peripheral entry E1 and two exits S1, S2.

In practice, the combination of the paying out spool B1, the bay 13 and the assembly system 16 constitutes a lyre-type horizontal pairing machine PHL.

The lyre-type horizontal pairing machine PHL is well known in the art and is not described in more detail here.

Let N1 denote its rotational speed about its axis A1.

The twisting station 12 includes an assembly device which is a double-twist twisting machine DT in the embodiment shown.

The double-twist twisting machine DT is also well known in the art and is not described in complete detail here.

Suffice to say that, like the bay 13 of the twist-free assembly station 11, it includes a lyre 19 along which the cable c is fed as it is twisted. The finished cable c is directed towards the interior of the system and wound onto a take-up spool B3 inside the lyre 19.

Let N2 denote its rotational speed about its axis A2.

In a manner that is known in the art, the cable-making installation 10 according to the invention is completed by a drawing device, not shown, for example a capstan, adapted to advance the cable c at a given linear speed VL.

The wire f1 is twisted at the entry of the bay 13 and backtwisted at its exit.

It therefore enters the assembly system 16 free of twist.

Likewise, the wire f2 enters the assembly system 16 free of twist.

The two wires f1, f2 are then assembled in line with the die 18.

The corresponding assembly point A consists of the opening of the dic 18.

Let Tc1 denote the number of twists per unit length of the cable c at the assembly point A or, more generally, in the assembly area Z1 and let Tf1 denote the number of twists of the wires f1, f2 in the same area Z1 and under the same conditions.

Obviously:

$Tc1=N1/VL$ $Tf1=O$

Let Tc2 denote the number of twists of the cable c in the area Z2 of the double-twist twsting machine DT formed by the lyre 19 thereof and let Tc3 denote the number of twists in the area Z3 of the double-twist twisting machine DT between the exit from its lyre 19 and the take-up spool B3.

Let Tf2 denote the number of twists of the wires f1, f2 in the area Z2 and Tf3 denote the number of twists in the area Z3 under the same conditions.

Obviously:

$Tc2=N1/VL+N2/VL$ $Tc3=N1/VL+2\times N2/VL$ $Tf2=N2/VL$ $Tf3=2\times N2/VL$

Now let BT denote the rate of backtwisting, generally defined in the following manner as a function of the number of twists Tc of the cable c and the number of twists Tf of the wires f1, f2:

$BT=1-Tf/Tc$

It follows from the foregoing description that, in the area Z3 of the double-twist twisting machine DT, in which the cable c is finished, the rate of backtwisting BT obtained is as follows;

$BT=1-2\times N2/(N1+2\times N2)$

The production rate P, or productivity, of the cable-making installation 10 according to the invention, defined as the number of twists per unit time, has the following value:

$P=N1+2\times N2$

For example, if the rotational speeds N1, N2 have the same value N, the rate of backtwisting BT and the production rate P have the following values:

$BT=1-0.66=0.33$ (33%)

$P=3N$

The rate of backtwisting 15T and the production rate P vary with the rotational speed values N1, N2, however.

In the foregoing description, the absolute values of the various parameters involved are specified, for convenience only.

However, the rotational speeds N1, N2 are obviously of opposite sign, for example.

In the FIG. 3 graph, the rotational speed N2 in rpm of the double-twist twisting machine DT is plotted on the abscissa axis and the rotational speed N1 in rpm of the lyre-type horizontal pairing machine PHL is plotted on the ordinate axis. The graph shows the rate of backtwisting BT obtained by moans of a first set of straight line segments D1, all starting at the origin, and the production rate P obtained by means of a second set of parallel straight line segments D2 which intersect the abscissa axis and the ordinate axis.

To obtain a regular cable c, it is important for the tensions T1, T2 in the wires f1, f2 to be substantially equal at the assembly point A.

Although the tension T2 in the wire f2 is practically undisturbed throughout the path of the wire f2 between the second paying out spool B2 and the assembly point A, the same cannot be said of the tension T1 in the wire f1 between the first paying out spool B1 and the assembly point A.

To the contrary, this tension T1 is greatly disturbed by routing the wire f2 along the lyre 15 of the assembly device 14.

Thus although the tension T2 in the wire f2 at the assembly point A is relatively easy to control, the same cannot be said of the tension T1 in the wire f1 at the assembly point A.

To overcome this problem, the cable-making installation 10 according to the invention includes, between the twist-free assembly station 11 and the twisting station 12, a tension measuring device 20 controlling a braking device 21 controlling the first paying out spool B1, as symbolized in chain-dotted outline in FIG. 1.

A braking device 22 controls the second paying out spool B2.

The tension measuring device 20 is well known in the art and is not described here.

It measures the tension T3 in the cable c downstream of the die 18.

In accordance with the invention, under the control of the braking device 22, the tension T2 in the wire f2 at the assembly point A is made substantially constant in all circumstances, in particular despite variations in the diameter of the wire f2 as it is paid out.

Under the control of the braking device 21, the tension T3 in the cable c at the exit from the twist-free assembly station 11, as measured by the tension measuring device 20, is made substantially equal to twice the tension T2 in the wire f2 at the exit from the second paying out spool B2.

This makes it virtually certain that the tensions T1 and T2 in the wires f1 and f2 at the assembly point A are substantially equal, as required.

Figure 4:
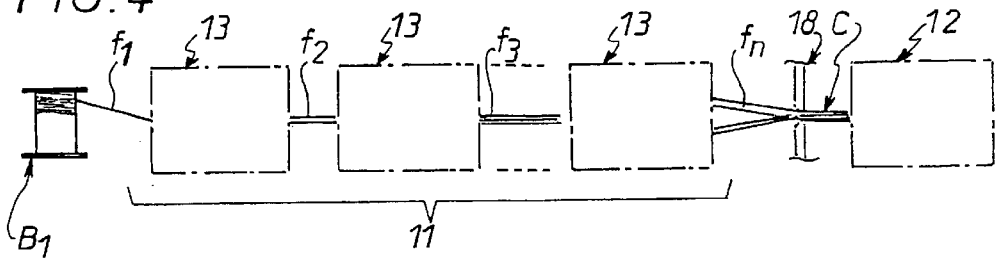
FIG. 4 is a more general block diagram of a cable-making installation according to the invention.

If the cable c to be fabricated must include more than two wires f1, f2, . . . , fn, as shown diagrammatically in FIG. 4, the twist-free assembly station 11 includes a plurality of bays 13 in series.

The number n' of bays 13 is equal to n−1 in practice.

It is not necessary for the cable c formed by the wires f1, f2, . . . , fn to be twisted twice at the twisting station 12.

More generally, it is sufficient for the cable c to be twisted at least once at the twisting station 12.

In other words, it is sufficient for the twisting station 12 to include an assembly device such as a single-twist assembly device, a rotating reception assembly device or a double-twist assembly device, for example.

The present invention is not limited to the embodiments briefly described and shown but encompasses any variant execution and/or combination of their various component parts.

What is claimed is:

1. A cable-making installation for making an at least partially backtwisted cable including in series on a common production line a twist-free assembly station adapted to combine at least two wires without individually twisting them, followed by a twisting station adapted to twist a combination of the two wires at least once, wherein said twist-free assembly station includes in addition to a first paying out spool, at least one bay formed of an assembly device inside which is a second paying out spool, and wherein said twist-free assembly station includes an assembly system at an exit to said twist-free assembly station, formed of a drum which has an axial entry and at least one peripheral entry and exclusively peripheral exits, and a die downstream of said drum.

2. The cable-making installation claimed in claim 1 wherein said assembly device of each said at least one bay is a lyre-type assembly device.

3. The cable-making installation claimed in claim 1 wherein said twist-free assembly station includes a plurality of bays in series.

4. The cable-making installation claimed in claim 1 wherein said twisting station includes an assembly device selected from one of a single-twist assembly device, a rotating reception assembly device and a double-twist assembly device.

5. The cable-making installation claimed in claim 1, further comprising a tension measuring device for controlling a braking device controlling said first paying out spool, said tension measuring device being between said twist-free assembly station and said twisting station.

6. The cable-making installation claimed in claim 1, further comprising a braking device controlling said first paying out spool, said braking device being between said twist-free assembly station and said twisting station, and wherein tension in said cable at an exit from said twist-free assembly station is substantially equal to twice a tension of a wire at an exit from said second paying out spool.

* * * * *